US010448697B2

(12) United States Patent
Ito et al.

(10) Patent No.: US 10,448,697 B2
(45) Date of Patent: Oct. 22, 2019

(54) SHOE UPPER AND SHOE INCLUDING THE SHOE UPPER

(71) Applicant: MIZUNO CORPORATION, Osaka (JP)

(72) Inventors: Kouji Ito, Osaka (JP); Shin Hirai, Osaka (JP); Tsuyoshi Ieta, Osaka (JP)

(73) Assignee: MIZUNO CORPORATION, Osaka (JP)

( * ) Notice: Subject to any disclaimer, the term of this patent is extended or adjusted under 35 U.S.C. 154(b) by 162 days.

(21) Appl. No.: 15/493,592

(22) Filed: Apr. 21, 2017

(65) Prior Publication Data

US 2017/0303639 A1 Oct. 26, 2017

(30) Foreign Application Priority Data

Apr. 26, 2016 (JP) ..... 2016-088365

(51) Int. Cl.
*A43B 5/00* (2006.01)
*A43B 5/02* (2006.01)
(Continued)

(52) U.S. Cl.
CPC ..... *A43B 5/00* (2013.01); *A43B 23/027* (2013.01); *A43B 23/0245* (2013.01); *A43B 23/087* (2013.01)

(58) Field of Classification Search
CPC .. A43B 5/00; A43B 5/02; A43B 5/025; A43B 23/0245; A43B 23/027;
(Continued)

(56) References Cited

U.S. PATENT DOCUMENTS 1,677,370 A * 7/1928 Roewade ..... A43B 5/02 36/128
4,813,158 A * 3/1989 Brown ..... A43B 5/00 36/114
(Continued)

FOREIGN PATENT DOCUMENTS

DE 2743666 A1 * 3/1978 ..... A43B 5/02
EP 1825996 A1 * 8/2007 ..... A43B 13/12
(Continued)

OTHER PUBLICATIONS

Japanese Reasons for Refusal issued in counterpart application No. JP2016-088365 dated Dec. 4, 2018.

*Primary Examiner* — Jameson D Collier
(74) *Attorney, Agent, or Firm* — Troutman Sanders LLP; Daniel Sharpe

(57) ABSTRACT

A shoe upper of a shoe includes first and second shoe upper sections together surrounding a foot, while covering a tiptoe and a heel of the foot, and a protector provided on part of an outer surface of the second shoe upper section and made of a single type of abrasion resistant resin material. The protector includes a tiptoe protector arranged to correspond to a tiptoe portion of the second shoe upper section, and a medial region protector provided on a medial region, of the second shoe upper section, extending from a backend of the tiptoe protector to a portion of the midfoot. The medial region protector has a deformable portion which has a mesh structure and is more deformable than the tiptoe protector, and a plurality of reinforcement ribs which divide the deformable portion into a plurality of regions.

14 Claims, 6 Drawing Sheets

(51) Int. Cl.
*A43B 1/14* (2006.01)
*A43B 23/02* (2006.01)
*A43B 23/08* (2006.01)

(58) Field of Classification Search
CPC ..... A43B 23/087; A43B 23/0265; A43B 23/0275; A43B 23/081; A43B 23/0235; A43B 23/0215; A43B 23/028; A43B 23/026; A43B 23/0295
USPC ..... 36/45, 433, 77 R, 83, 114, 128, 3 A, 84, 36/87, 126
See application file for complete search history.

(56) References Cited

U.S. PATENT DOCUMENTS 6,108,943 A * 8/2000 Hudson ..... A43B 5/10 36/102
6,170,174 B1 * 1/2001 Gesso ..... A43B 5/00 36/126
6,523,282 B1 * 2/2003 Johnston ..... A43B 5/02 36/133
8,789,298 B2 * 7/2014 Eder ..... A43B 5/02 36/133
9,038,288 B2 * 5/2015 Droege ..... A43B 5/025 36/133
2002/0185213 A1 12/2002 Marega et al.
2005/0268497 A1 * 12/2005 Alfaro ..... A43B 1/0027 36/136
2005/0282454 A1 * 12/2005 Meschter ..... A41D 1/04 442/306
2013/0074374 A1 3/2013 Droege et al.
2013/0125417 A1 * 5/2013 Minanni ..... A43B 5/025 36/83
2013/0232815 A1 * 9/2013 Meythaler ..... A43B 23/0225 36/45
2014/0157631 A1 * 6/2014 Dodd ..... A41D 13/0153 36/115
2014/0259760 A1 * 9/2014 Dojan ..... A43B 23/026 36/45
2015/0040440 A1 * 2/2015 Tozzi ..... A43B 23/087 36/77 R
2015/0257476 A1 * 9/2015 Panian ..... A43B 5/00 36/114
2017/0049186 A1 * 2/2017 Lee ..... A43B 23/027

FOREIGN PATENT DOCUMENTS

JP H09191902 A 7/1997
JP 2001017206 A 1/2001
JP 2008-284113 A 11/2008
JP 2011087916 A 5/2011

* cited by examiner

SHOE UPPER AND SHOE INCLUDING THE SHOE UPPER

CROSS-REFERENCE TO RELATED APPLICATIONS

This nonprovisional application claims priority to Japanese Patent Application No. 2016-088365 filed on Apr. 26, 2016, the entire disclosure of which is hereby incorporated by reference.

BACKGROUND

The present disclosure relates to a shoe upper and a shoe including such a shoe upper.

When a wearer of conventional baseball shoes pitches or throws a baseball, at the end of the pitching or throwing motion, his/her pivot foot which is positioned behind him/her rubs against the ground. Specifically, an area, of the pivot foot, including a tiptoe portion and a medial region extending from the backend of the tiptoe portion to a portion of the midfoot rubs against the ground, and friction is generated between the ground and an area, of the shoe upper of his/her shoe, including a tiptoe portion and a medial region from the backend of a tiptoe portion to a portion of midfoot. It is therefore unavoidable that this area of the shoe upper is easily deteriorated due to abrasion.

An exemplary guard for a tiptoe portion of a shoe upper of a shoe such as a baseball shoe is known from Japanese Unexamined Patent Publication No. 2008-284113. This patent document discloses a tiptoe cover designed for a sport shoe and including a vamp portion at least partially covering a front portion of a vamp of the shoe, and a protective portion configured to be attached to a foremost portion of the shoe and comprised of a body and a sole.

SUMMARY

Such a tiptoe cover for preventing deterioration of a shoe upper due to abrasion, as the one disclosed in Japanese Unexamined Patent Publication No. 2008-284113, is called "pitcher's toe guard." Under present circumstances, baseball players attach such a separate toe guard to the outer surface of the shoe upper of his/her shoe in order to increase the lifetime of his/her shoe.

However, the above measure is very troublesome: a user needs to buy a pitcher's toe guard separately from his/her shoes, and to attach the separate toe guard to his/her shoe. In addition, the pitcher's toe guard is configured to be attached, at its protective portion, which has a uniform thickness, to a tiptoe portion of a shoe upper, without covering other portions of the shoe upper. Therefore, the pitcher's toe guard lacks, by nature, a function of protecting a medial region of the midfoot of a shoe upper. Thus, using the pitcher's toe guard of Japanese Patent Publication No. 2008-284113, it is practically difficult to protect the medial region, of a shoe upper, extending from the backend of the tiptoe portion to a portion of the midfoot, and to prevent abrasion in the medial region of the shoe upper.

It is therefore an object of the present disclosure to prevent abrasion of a shoe upper of shoes which occurs, for example, when a wearer of the shoes plays or practices a sport such as baseball, and to protect an area, of the shoe upper, including a tiptoe portion and a medial region extending from a backend of the tiptoe portion to a portion of the midfoot suitably for a long period of time.

To achieve the above object, a first aspect of the present disclosure relates to a shoe upper. This shoe upper includes a shoe upper body surrounding a foot of a wearer, while covering a tiptoe and a heel of the foot; and a protector provided on part of an outer surface of the shoe upper body, and made of a single type of abrasion resistant resin material. The protector includes a tiptoe protector arranged to correspond to a tiptoe portion of the shoe upper body, and a medial region protector provided on a medial region, of the shoe upper body, extending from a backend of the tiptoe protector to a portion of the midfoot. The medial region protector has a deformable portion that is more deformable than the tiptoe protector, and a plurality of reinforcement ribs that divide the deformable portion into a plurality of regions.

For example, when a wearer of the shoe upper of the present disclosure pitches or throw a baseball, having a tiptoe portion of he/she pivot foot rubbing against the ground, abrasion may occur in an area, of the shoe upper body, including the tiptoe portion extending from a medial side to a lateral side and a medial region extending from the backend of the tiptoe portion to a portion of the midfoot. According to the first aspect of the present disclosure, the tiptoe protector and the reinforcement ribs of the medial region protector may reduce the abrasion. On the other hand, when the wearer sprints or performs pitching, fielding, or hitting steps, for example, the deformable portion follows the bending of the joints of the toes (in particular, the big toe), thereby facilitating firm stepping on the ground. Thus, the protector comprised of the tiptoe protector and the medial region protector may reduce the risk of tearing or rupturing of the shoe upper body due to abrasion, while the deformable portion of the medial region protector enables the wearer to easily bend his/her toe joints in the medial region, of his/her foot, extending from backend of the tiptoe portion to a portion of the midfoot. As a result, an area, of the shoe upper body, including the tiptoe portion and the medial region extending from the backend of the tiptoe portion to a portion of the midfoot may be suitably protected for a long period of time. Further, the shoe upper of the present disclosure may eliminate the need for purchasing a separate pitcher's toe guard and for additional work involving attaching the pitcher's toe guard to the shoe.

A second aspect of the present disclosure is an embodiment of the first aspect. In this aspect, the reinforcement ribs extend obliquely toward a lower portion of the shoe upper body and toward the heel of the foot.

According to this second aspect, the reinforcement ribs allow the wearer to easily bend the joints of his/her toes (in particular, his/her big toe), which are located in the medial region, in the direction in which the reinforcement ribs extend obliquely, while maintaining the abrasion resistance and stiffness.

A third aspect of the present disclosure is an embodiment of the first aspect. In this aspect, the reinforcement ribs extend obliquely toward a lower portion of the shoe upper body and toward the tiptoe of the foot.

In the same manner as the configuration of the second aspect, a configuration as the one of the third aspect, in which the reinforcement ribs extend obliquely toward the lower portion of the shoe upper body and toward the tiptoe, also allows the wearer to easily bend the joints of his/her toes (in particular, his/her big toe), which are located in a medial region, in the direction in which the reinforcement ribs extend obliquely, while maintaining the abrasion resistance and stiffness.

A fourth aspect of the present disclosure is an embodiment of the first aspect. In this aspect, the deformable portion has a mesh structure comprised of a plurality mesh members made of the abrasion resistant resin material and intersecting with each other.

According to the fourth aspect, configuring the deformable portion to have the mesh structure made of the abrasion resistant resin material may make the deformable portion more deformable than the tiptoe protector, while maintaining the abrasion resistance of the deformable portion. In addition, the mesh structure may maintain the breathability of the shoe upper body.

A fifth aspect of the present disclosure is an embodiment of the first aspect. In this aspect, the deformable portion is thinner than the tiptoe protector.

The simple configuration according to the fifth aspect, in which the deformable portion is thinner than the tiptoe protector, may make the deformable portion more deformable than the tiptoe, while maintaining the abrasion resistance.

A sixth aspect of the present disclosure is an embodiment of the first aspect. In this aspect, the protector is made of thermosetting polyurethane.

According to the sixth aspect, the properties of the thermosetting polyurethane contribute to the enhancement of the abrasion resistance of the protector.

A seventh aspect of the present disclosure is an embodiment of the first aspect. In this aspect, an outer surface of the protector is flush with an outer surface of a portion, of the shoe upper body, not provided with the protector.

According to the seventh aspect, the protector is flush with the portion of the shoe upper body that is not provided with the protector. Therefore, the seam between the protector and the shoe upper body has no point from which the protector could start to peel off. This may substantially prevent the protector from peeling off the shoe upper body.

An eighth aspect of the present disclosure is an embodiment of the first aspect. In this aspect, the tiptoe protector is located in front of metatarsophalangeal joints of the wearer.

According to the eighth aspect, the tiptoe protector may suitably protect the tiptoe portion of the shoe upper body, without hindering the wearer from moving his/her metatarsophalangeal joints.

A ninth aspect of the present disclosure relates to a shoe including the shoe upper according to any one of the first to eighth aspects.

According to the ninth aspect, a shoe as beneficial as the one of any one of the first to eighth aspects is provided.

As can be seen from the foregoing, when using the shoe upper according to the present disclosure, the protector comprised of the tiptoe protector and the medial region protector may reduce the risk of the shoe upper body tearing due to abrasion, while the deformable portion of the medial region protector allows for easy bending of the toe joints in the medial region extending from backend of the tiptoe portion to a portion of the midfoot. As a result, an area, of the shoe upper body, including the tiptoe portion and the medial region extending from the backend of the tiptoe portion to a portion of the midfoot may be suitably protected for a long period of time. Further, the shoe upper according to the present disclosure may eliminate the need for purchasing a pitcher's toe guard and for additional work involving attaching the pitcher's toe guard to a shoe.

DETAILED DESCRIPTION

Figure 1:
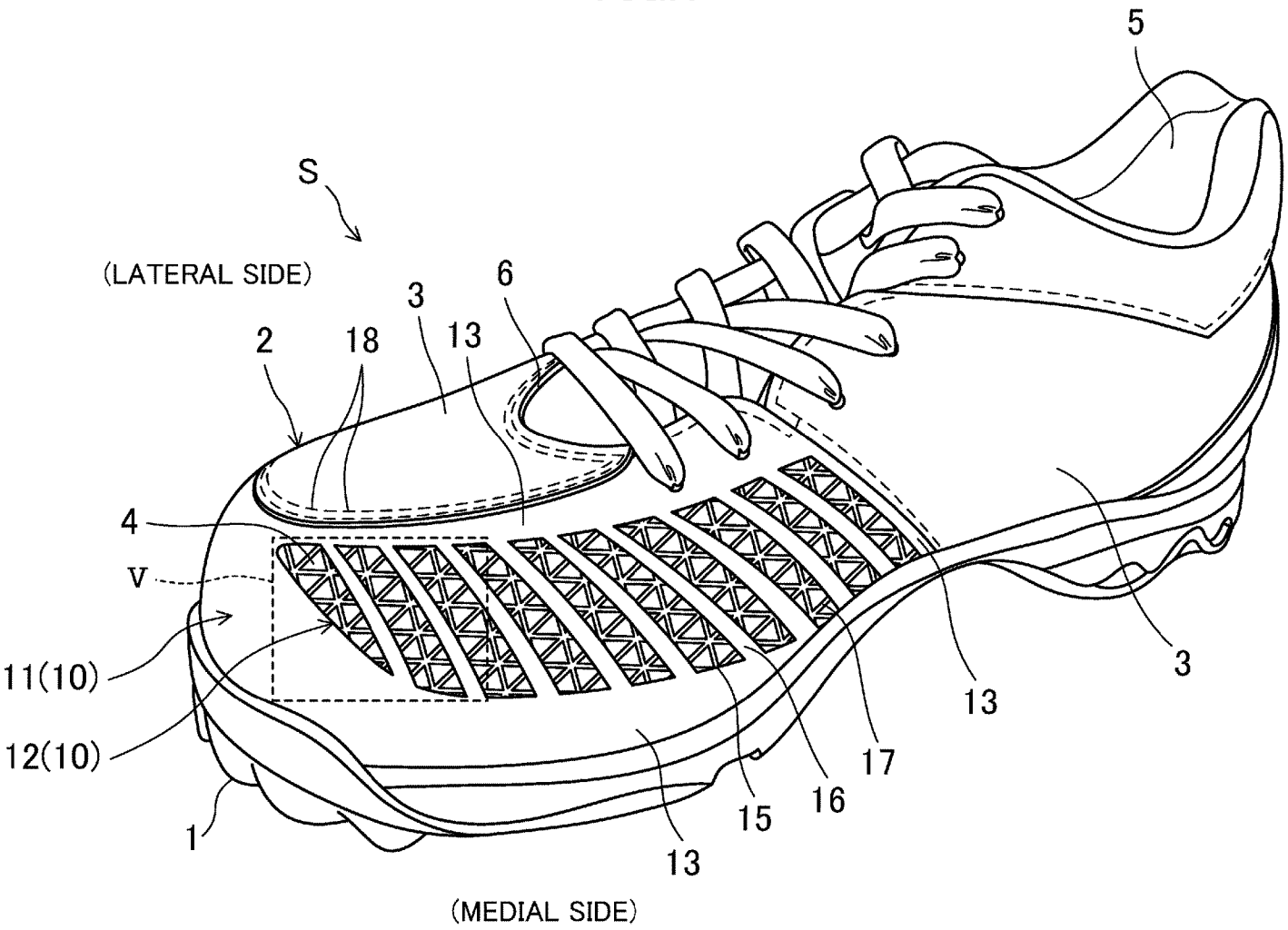
FIG. 1 is a medial perspective view of a shoe according to a first embodiment of the present disclosure, as viewed from above.

Embodiments of the present disclosure will now be described in detail with reference to the drawings. The following description of the embodiments is merely an example by nature, and is not intended to limit the scope, application, or uses of the present disclosure.

First Embodiment

FIGS. 1-6 illustrate a shoe S according to a first embodiment of the present disclosure. The shoe S can be used as a baseball or softball shoe. In the drawings, only the right shoe of a pair of shoes S is illustrated as an example. Since the left shoe is symmetrical to the right shoe S, only the right shoe S will be described in the following description, and the description of the left shoe will be omitted herein. In the following description, the expressions "above," "upward," "on a/the top of," "below," "under," and "downward," represent the vertical positional relationship between respective parts of the shoe S, and "front," "fore," "back," and "hind" represent the longitudinal positional relationship between respective parts of the shoe S. The expressions "left side" and "right side" represent the positional relationship between respective parts in the width direction in the shoe S.

Figure 2:
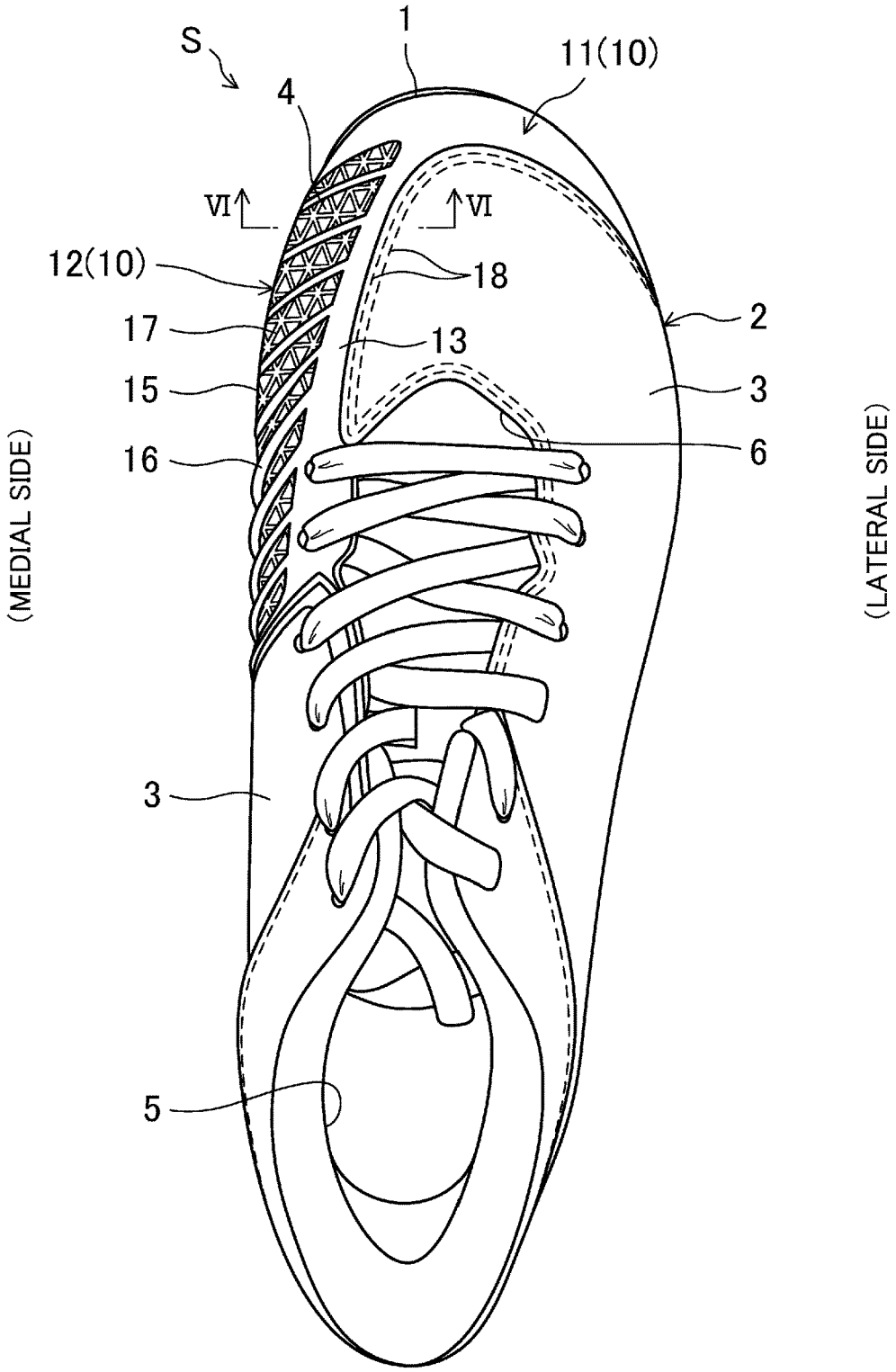
FIG. 2 is a plan view of the shoe.
Figure 3:
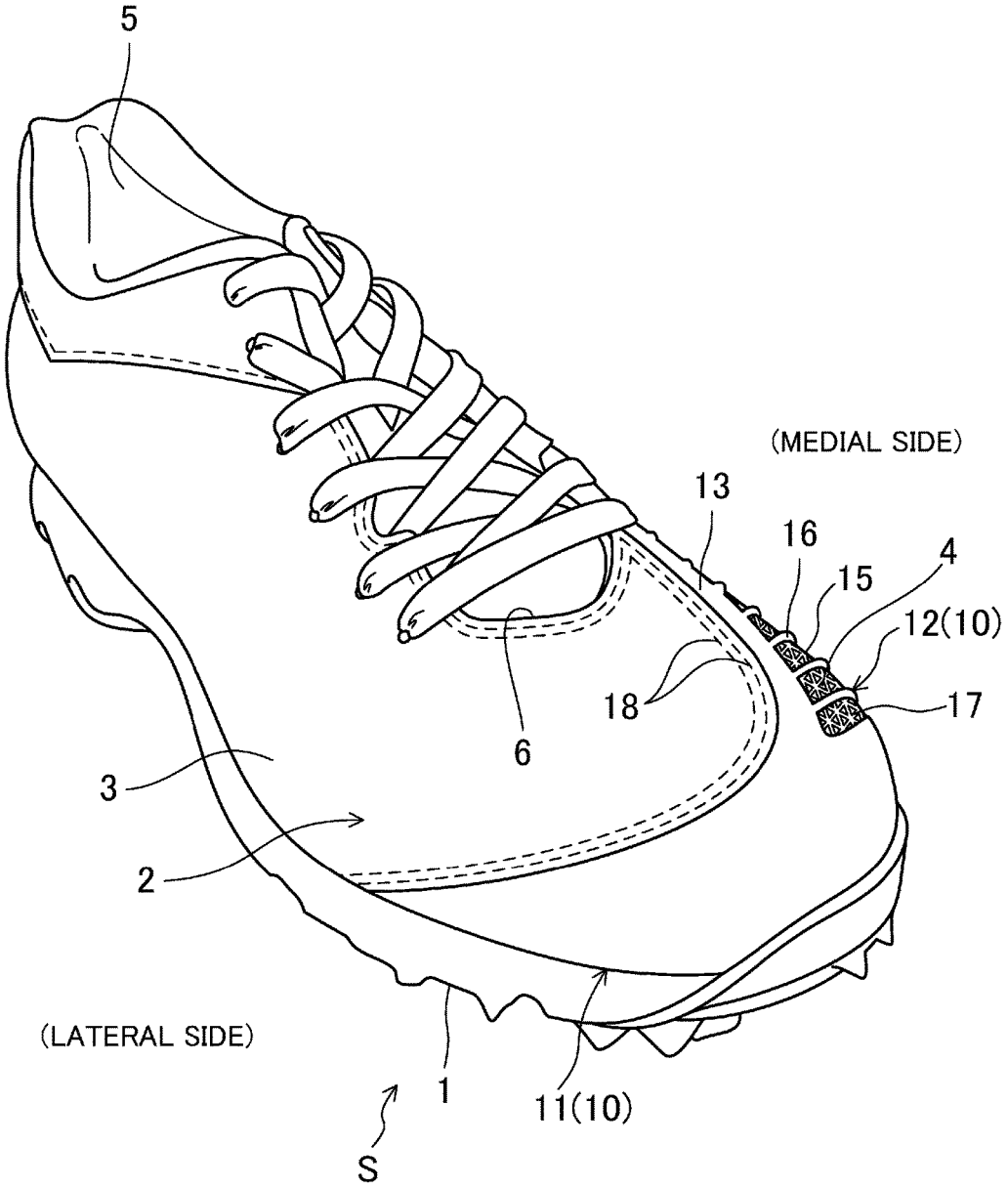
FIG. 3 is a lateral perspective view of the shoe, as viewed from above.

As illustrated in FIGS. 1-3, the shoe S includes a sole 1 having a ground surface that touches the ground. The sole 1 is made of a soft elastic material. Specifically, examples of such soft elastic materials include thermoplastic resins such as ethylene-vinyl acetate copolymer (EVA) and their foams, thermosetting resins such as polyurethane (PU) and their foams, and rubber materials such as butadiene rubber and chloroprene rubber and their foams.

The shoe S further includes a shoe upper 2 provided over the sole 1. This shoe upper 2 includes a shoe upper body 3,4 which surrounds a wearer's foot, while covering the tiptoe of the forefoot F and the heel of the hindfoot H (see FIG. 4). The shoe upper body 3, 4 is comprised of a first shoe upper section 3 and a second shoe upper section 4. The first and second shoe upper sections 3 and 4 are made of synthetic leather, for example, and configured to fit the shape of a wearer's foot and hold the wearer's foot suitably.

Here, the second shoe upper section 4 covers an area which includes a tiptoe portion extending from the medial side to the lateral side of the forefoot F and a medial region extending from the forefoot F to a portion of the midfoot M. In other words, the second shoe upper section 4 is arranged to correspond to a protector 10, which will be described later, whereas the first shoe upper section 3 is arranged in an area not provided with the protector 10. The first and second shoe upper sections 3 and 4, which have their peripheral portions overlapping with each other, are sewn together with sewing threads 18 and 18 (see FIG. 6). The lower peripheries of the first and second shoe upper sections 3 and 4 are integrally bonded to the entire periphery of the sole 1 with an adhesive or any other means.

The shoe S has a shoe opening 5 at its hind portion above the first and second shoe upper sections 3 and 4. The shoe opening 5 has a substantially elliptic shape having its major axis extending in the longitudinal direction of the shoe S in a plan view, and configured to fit the periphery of an ankle of the wearer. The shoe S further has a throat 6 opening at a portion corresponding to respective upper areas of the first and second shoe upper sections 3 and 4. The throat 6 is an opening continuous with, and extending forward from, a front end of the shoe opening 5. The throat 6 is formed to be located on the instep of the foot of the wearer, and has its front end reaching a point corresponding to a substantial center, in the longitudinal direction, of the forefoot F of the wearer (e.g., the vicinity of the distal heads of the metatarsal bones).

As a feature of the present disclosure, the shoe upper 2 includes the protector 10 provided on part of the outer surface of the second shoe upper section 4, as illustrated in FIGS. 1-4. The protector 10 is formed by injection-molding a single type of abrasion resistant resin material functioning as a constituent material, and bonded to the outer surface of the second shoe upper section 4 (see FIG. 6). Specifically, examples of suitable materials for the protector 10 include thermosetting polyurethane and rubber materials. To obtain a suitable abrasion resistance, thermosetting polyurethane is more beneficial than rubber materials.

Figure 4:
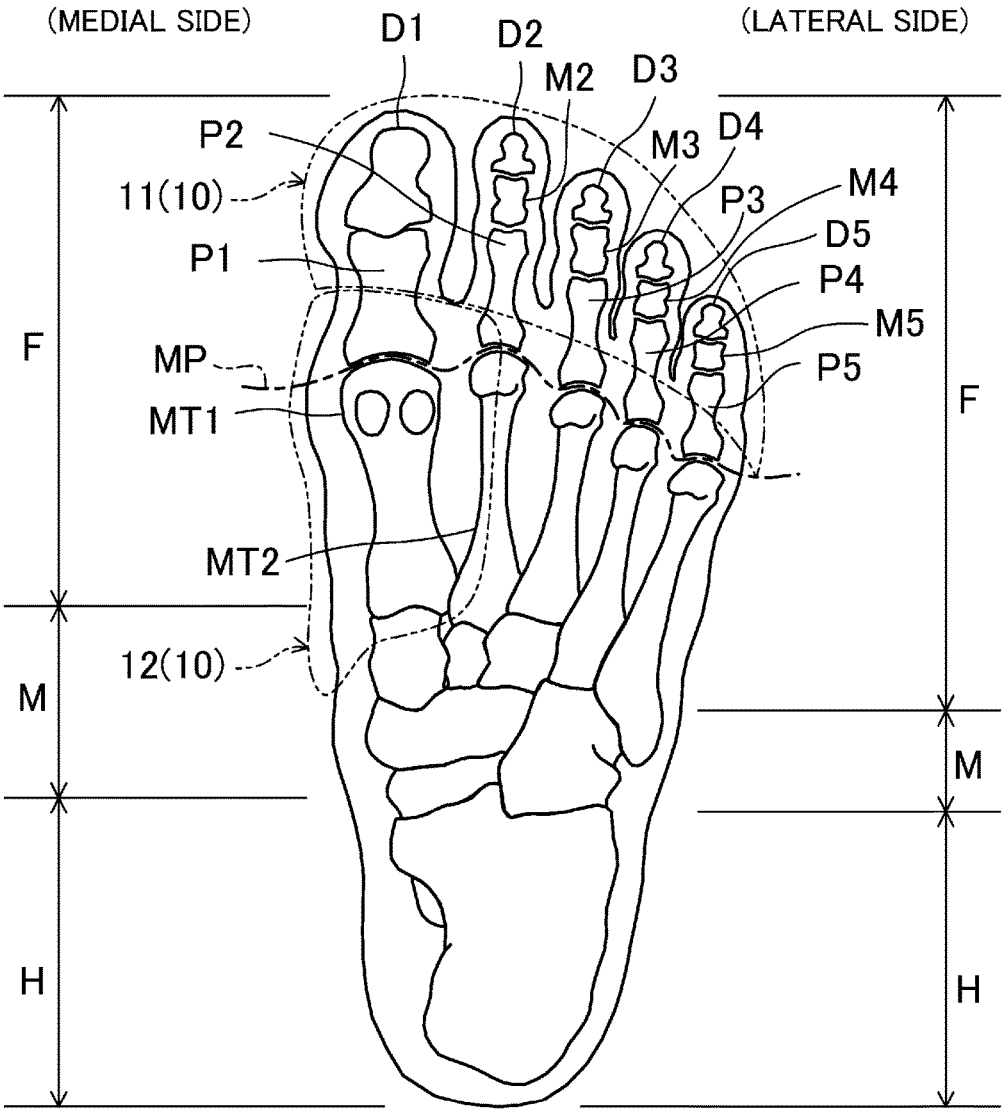
FIG. 4 schematically illustrates a skeleton of a human foot and a protector in an overlapping fashion.

The protector 10 includes a tiptoe protector 11 arranged to correspond to a tiptoe portion of the second shoe upper section 4. As illustrated in FIG. 4, the tiptoe protector 11 is located in front of metatarsophalangeal joints MP of the wearer's foot. Specifically, the tiptoe protector 11 is arranged in a region including proximal phalanges P1-P5, middle phalanges M2-M5, and distal phalanges D1-D5 of the first to fifth toes of the wearer's foot, and configured to cover the entire tiptoe portion of the forefoot F. The tiptoe protector 11 has a uniform thickness of about 1.5 mm to about 3.5 mm, for example, in order to maintain its abrasion resistance and high stiffness.

The protector 10 further includes a medial region protector 12 provided on a medial region, of the second shoe upper section 4, extending from a backend of the tiptoe protector 11 to a portion of the midfoot M. Specifically, as illustrated in FIG. 4, the medial region protector 12 covers a region including the respective back ends of the first and second proximal phalanges P1 and P2 of the forefoot F and first and second metatarsal bones MT1 and MT2.

The medial region protector 12 has, at its portions adjacent to the sole 1 and the first shoe upper section 3, peripheral portions 13, 13, . . . which are as thick as the tiptoe protector 11 and continuous with the tiptoe protector 11 such that the outer surfaces of the peripheral portions 13, 13, . . . are flush with the outer surface of the tiptoe protector 11.

Figure 6:
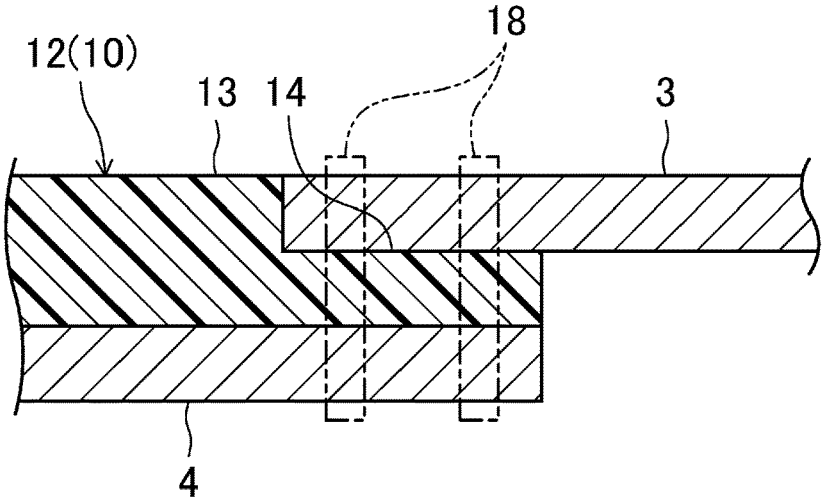
FIG. 6 is a cross-sectional view taken from line VI-VI in FIG. 2.

As illustrated in FIG. 6, the peripheral portion 13 of the medial region protector 12 has a step 14 formed by cutting out a part from the outer surface of the medial region protector 12 in a thickness direction. A peripheral portion of the first shoe upper section 3 is placed on the step 14. Thus, the medial region protector 12, which is sandwiched between the peripheral portions of the first and second shoe upper sections 3 and 4, is sewn and attached to the first and second shoe upper sections 3 and 4 with the sewing threads 18 and 18. Being attached in this manner, the outer surface of the medial region protector 12 is flush with the outer surface of the first shoe upper section 3. The tiptoe protector 11 is also attached to the first and second shoe upper sections 3 and 4 in the same manner as the medial region protector 12. Detailed description of the tiptoe protector 11 is therefore omitted herein.

The medial region protector 12 has a deformable portion 15, which is more deformable than the tiptoe protector 11, and a plurality of reinforcement ribs 16, 16, . . . provided in the deformable portion 15 to increase the stiffness of the medial region protector 12. The deformable portion 15 and the reinforcement ribs 16 are made of the same abrasion resistant resin material (e.g., thermosetting polyurethane) as the tiptoe protector 11. The deformable portion 15 and the reinforcement ribs 16 are arranged in a region surrounded by the backend of the tiptoe protector 11 and the peripheral portions 13 of the medial region protector 12.

Figure 5:
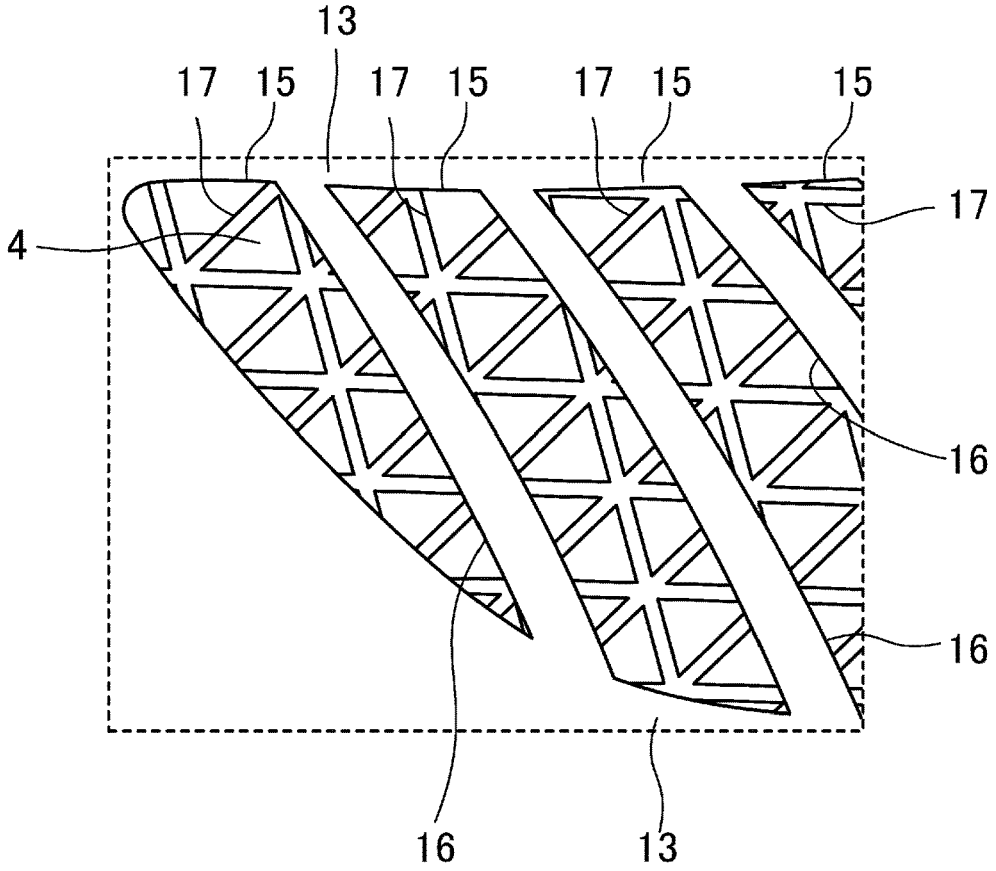
FIG. 5 illustrates, on an enlarged scale, a portion of the shoe upper, indicated with V in FIG. 1.

As illustrated in FIGS. 1 and 5, each reinforcement rib 16 extends across the deformable portion 15, from the peripheral portion 13 of the medial region protector 12 adjacent to the first shoe upper section 3 to another peripheral portion 13 of the medial region protector 12 adjacent to the sole 1. Each reinforcement rib 16 obliquely extends toward a lower portion of the second shoe upper section 4 (i.e., the lower peripheral portion 13 of the medial region protector 12) and toward the heel of the hindfoot H. The plurality of reinforcement ribs 16, 16, . . . are arranged at predetermined intervals in the longitudinal direction so as to divide the deformable portion 15 into a plurality of regions. Each region of the deformable portion 15 has a mesh structure comprised of a plurality of mesh members 17, 17, . . . which intersect with each other to form meshes having a substantially triangle shape. Each mesh member 17 is continuous with the backend of the tiptoe protector 11 and/or (an) associated one or ones of the peripheral portions 13.

Each reinforcement rib 16 is thicker in the outward direction along a normal line of the second shoe upper section 4 than the tiptoe protector 11. However, each reinforcement rib 16 may have substantially the same thickness as the tiptoe protector 11, for example.

As can be seen, the shoe upper 2 of the shoe S according to this embodiment may reduce abrasion which can occur, for example, when a tiptoe portion of the pivot foot of a wearer rubs against the ground at the end of his/her pitching or throwing motion. Specifically, the tiptoe protector 11 and the reinforcement ribs 16 of the medial region protector 12 of the shoe upper 2 may reduce abrasion that can occur in the area, of the second shoe upper section 4, which includes the tiptoe portion extending from the medial side to the lateral side, and the medial region extending from the backend of the tiptoe portion to a portion of the midfoot. On the other hand, when the wearer sprints or performs pitching, fielding, or hitting steps, for example, the regions of the deformable portion 15 follow the bending of the joints of his/her toes (in particular, his/her big toe), thereby facilitating firm stepping on the ground. Thus, the protector 10 comprised of the tiptoe protector 11 and the medial region protector 12 may reduce the risk of the shoe upper 2 (the second shoe upper section 4) tearing due to abrasion, while the deformable portion 15 of the medial region protector 12 enables the wearer to easily bend the joints of his/her toes in a medial region, of his/her foot, extending from a backend of the tiptoe portion to a portion of the midfoot M. As a result, the area, of the shoe upper 2 (the second shoe upper section 4), which includes the tiptoe portion, and the medial region extending from the backend of the tiptoe portion to a portion of the midfoot M may be suitably protected for a long period of time. Further, the shoe upper 2 of the shoe S according to this embodiment may eliminate the need for purchasing a pitcher's toe guard and for additional work involving attaching the pitcher's toe guard to a shoe.

The reinforcement ribs 16, which obliquely extend toward a lower portion of the second shoe upper section 4 and toward the heel of the foot, allow the wearer to easily bend the joints of his/her toes (in particular, his/her big toe), which are located in a medial region, in the direction in which the reinforcement ribs 16 extend obliquely, while maintaining the abrasion resistance and stiffness.

Configuring the deformable portion 15 to have the mesh structure comprised of the plurality of mesh members 17, 17, . . . which are made of the abrasion resistant resin material and intersect with each other makes the deformable portion 15 more deformable than the tiptoe protector 11, while enabling the deformable portion 15 to maintain abrasion resistance. In addition, the mesh structure does not reduce, but may maintain, the breathability of the second shoe upper section 4 (the shoe upper body).

The outer surfaces of the tiptoe protector 11 and the medial region protector 12 are flush with the outer surface of the first shoe upper section 3. Therefore, the seams between the tiptoe protector 11 or the medial region protector 12 and the first shoe upper section 3 have no point from which the protectors 11 and 12 could start to peel off. This may substantially prevent the tiptoe protector 11 and the medial region protector 12 from peeling off the first and second shoe upper sections 3 and 4.

The tiptoe protector 11 is located in front of the metatarsophalangeal joints MP of the wearer's foot. Thanks to this location, the tiptoe protector 11 may suitably protect the tiptoe portion of the second shoe upper section 4, without hindering the wearer of the shoe S from moving his/her metatarsophalangeal joints MP.

Second Embodiment

Figure 7:
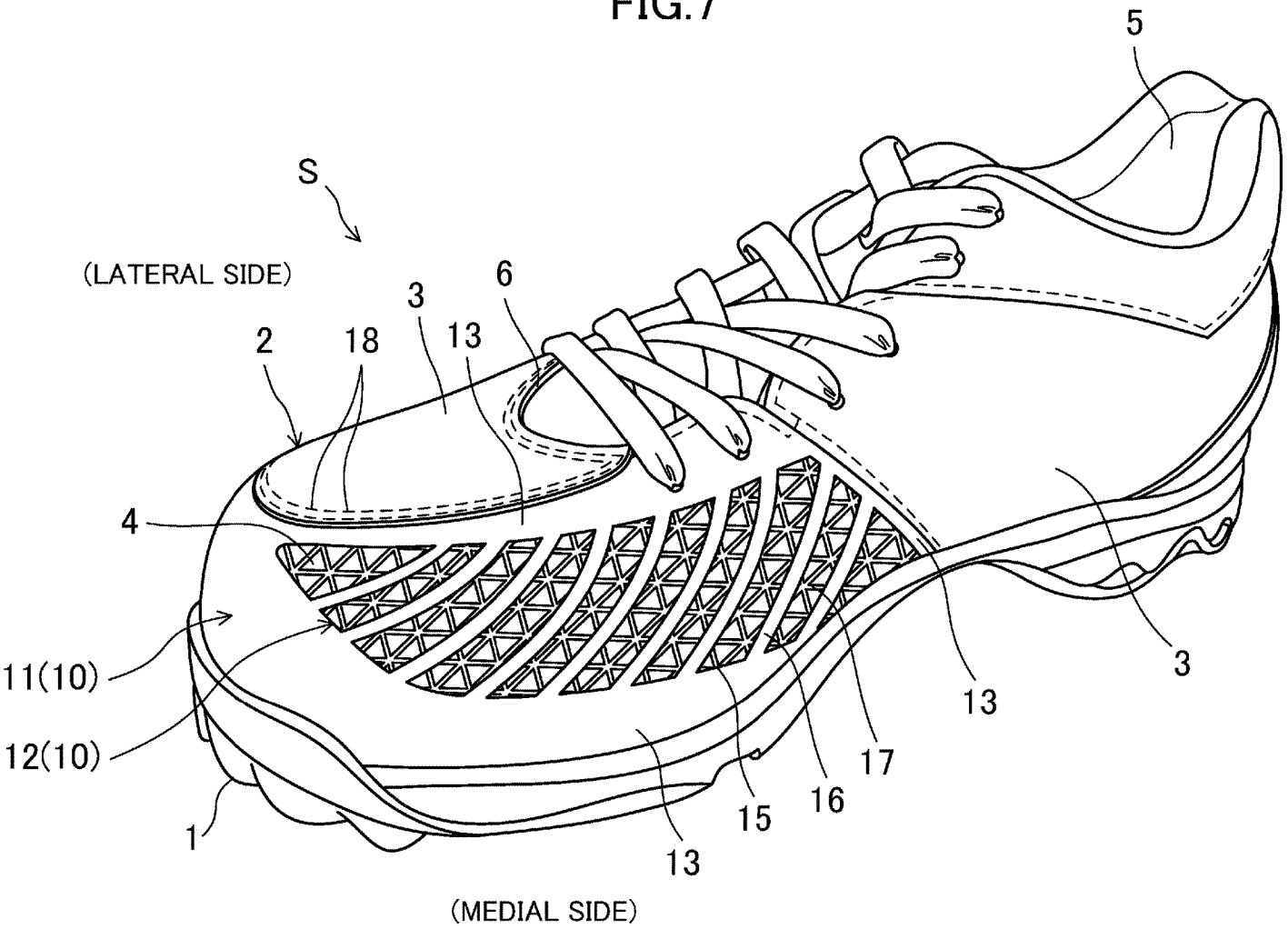
FIG. 7 is a medial perspective view of a shoe according to a second embodiment of the present disclosure, as viewed from above.

FIG. 7 illustrates a shoe S according to a second embodiment of the present disclosure. This embodiment differs from the first embodiment in the direction in which reinforcement ribs 16 extend obliquely. The configuration of the shoe S according to this embodiment is the same as or similar to that of the shoe S of the first embodiment. In the following description, components that are the same as those shown in FIGS. 1-6 will be identified by the corresponding reference characters, and detailed description thereof will be omitted herein.

As illustrated FIG. 7, the reinforcement ribs 16 extend obliquely toward a lower portion of a second shoe upper section 4 (i.e., a lower peripheral portion 13 of a medial region protector 12) and toward the tiptoe of the forefoot F. Like in the first embodiment, the reinforcement ribs 16 are arranged at predetermined intervals so as to divide a deformable portion 15 into a plurality of regions.

Just like the first embodiment, this configuration, in which the reinforcement ribs 16 extend obliquely toward the lower portion of the second shoe upper section 4 and toward the tiptoe of the forefoot F, allows the wearer to easily bend the joints of his/her toes (in particular, his/her big toe), which are located in a medial region, in the direction in which the reinforcement ribs 16 extend obliquely, while maintaining the abrasion resistance and stiffness.

Other Embodiments

In the embodiments described above, the deformable portion 15 has the mesh structure comprised of the plurality of abrasion resistant mesh members 17, 17, . . . intersecting with each other. However, the present disclosure is not limited to these embodiments. For example, the deformable portion 15 may be thinner than the tiptoe protector 11. Just like the embodiments described above, this simple configuration may make the deformable portion 15 more deformable than the tiptoe 11, while maintaining the abrasion resistance.

While the embodiments of the present disclosure have been described above, the present disclosure is not limited to those embodiments. Variations and modifications may be readily made to those embodiments within the scope of the present disclosure.

The present disclosure is industrially useful as a baseball shoe, for example.

What is claimed is:

1. A shoe upper comprising:

a shoe upper body configured to surround a wearer's foot while covering a tiptoe of the wearer's foot and a heel of the wearer's foot; and a protector provided on part of an outer surface of the shoe upper body, and made of an abrasion resistant resin material, wherein the protector includes a tiptoe protector arranged in a portion of the shoe upper body, the portion corresponding to a tiptoe portion of the wearer's foot, and made of the resin material, a medial region protector provided on the outer surface of the shoe upper body, configured to extend from a back end of the tiptoe protector in a medial region of the wearer's foot to a position corresponding to a midfoot of the wearer's foot, and having a deformable portion which is more deformable than the tiptoe protector, and a plurality of reinforcement ribs which divide the deformable portion into a plurality of regions, at least one mesh member is provided between the reinforcement ribs, the at least one mesh member being thinner than the reinforcement ribs, the reinforcement ribs and the at least one mesh member are made of the resin material, the at least one mesh member includes a plurality of mesh members, each of the plurality of mesh members has ends joined to the reinforcement ribs, and has a linear shape which is narrower in width than each reinforcement rib, and the deformable portion has a mesh structure comprised of the plurality of mesh members intersecting with each other.

2. The shoe upper of claim 1, wherein the reinforcement ribs extend obliquely toward a lower portion of the shoe upper body and are configured to extend toward the heel of the wearer's foot.

3. A shoe comprising the shoe upper of claim 2.

4. The shoe upper of claim 1, wherein the reinforcement ribs extend obliquely toward a lower portion of the shoe upper body and are configured to extend toward the tiptoe of the wearer's foot.

5. A shoe comprising the shoe upper of claim 4.

6. The shoe upper of claim 1, wherein the deformable portion is thinner than the tiptoe protector.

7. A shoe comprising the shoe upper of claim 6.

8. The shoe upper of claim 1, wherein the protector is made of thermosetting polyurethane.

9. A shoe comprising the shoe upper of claim 8.

10. The shoe upper of claim 1, wherein an outer surface of the protector is flush with an outer surface of a directly adjacent portion of the shoe upper body that is not provided with the protector.

11. A shoe comprising the shoe upper of claim 10.

12. The shoe upper of claim 1, wherein the tiptoe protector is configured to be located in front of metatarsophalangeal joints of the wearer's foot.

13. A shoe comprising the shoe upper of claim 12.

14. A shoe comprising the shoe upper of claim 1.

* * * * *